US012655974B2

(12) United States Patent
Deptolla

(10) Patent No.: US 12,655,974 B2
(45) Date of Patent: Jun. 16, 2026

(54) FLAME MONITORING DEVICE FOR A GAS BURNER APPLIANCE AND GAS BURNER APPLIANCE

(71) Applicant: Pittway SARL, Rolle (CH)

(72) Inventor: Uwe Deptolla, Lotte (DE)

(73) Assignee: Pittway SARL, Rolle (CH)

( * ) Notice: Subject to any disclaimer, the term of this patent is extended or adjusted under 35 U.S.C. 154(b) by 972 days.

(21) Appl. No.: 17/904,637

(22) PCT Filed: Feb. 2, 2021

(86) PCT No.: PCT/EP2021/052415

§ 371 (c)(1),
(2) Date: Aug. 19, 2022

(87) PCT Pub. No.: WO2021/165032

PCT Pub. Date: Aug. 26, 2021

(65) Prior Publication Data

US 2023/0090905 A1 Mar. 23, 2023

(30) Foreign Application Priority Data

Feb. 19, 2020 (EP) ..... 20158241

(51) Int. Cl.
*F23N 5/24* (2006.01)
*F23N 5/10* (2006.01)
*F23N 5/12* (2006.01)

(52) U.S. Cl.
CPC ..... *F23N 5/242* (2013.01); *F23N 5/102* (2013.01); *F23N 5/123* (2013.01); *F23N 2229/12* (2020.01); *F23N 2229/14* (2020.01)

(58) Field of Classification Search
None
See application file for complete search history.

(56) References Cited

U.S. PATENT DOCUMENTS 4,640,628 A * 2/1987 Seki ..... G08B 29/183 340/634
5,539,672 A 7/1996 Mullin et al.
(Continued)

FOREIGN PATENT DOCUMENTS

CN 203162944 U 8/2013
DE 4228948 A1 3/1994
DE 102008005216 B3 7/2009
(Continued)

OTHER PUBLICATIONS

International Search Report and Written Opinion in PCT International Application No. PCT/EP2021/052415 mailed Mar. 30, 2021.

*Primary Examiner* — Jason Lau
(74) *Attorney, Agent, or Firm* — Greenberg Traurig LLP; Ryan Sharp; Andrew Cull

(57) ABSTRACT

Flame monitoring device (23) for a gas burner appliance (10), the gas burner appliance (10) being configured to burn a combustible gas, the combustion of the combustible gas resulting into a flame (12), comprising a flame supervision device (24) providing as measurement signal an electrical voltage signal depending on the presence of the flame (12), and an electronic circuit (25) converting the electrical voltage signal provided by the flame supervision device (24) into an electrical current signal.

11 Claims, 2 Drawing Sheets

(56) References Cited

U.S. PATENT DOCUMENTS

| | | | | |
|---|---|---|---|---|
| 2016/0040876 | A1 | 2/2016 | Liao | |
| 2018/0202653 | A1* | 7/2018 | Karkow | F23D 14/145 |

FOREIGN PATENT DOCUMENTS

| | | | |
|---|---|---|---|
| EP | 1293727 | A1 | 3/2003 |
| EP | 2354657 | A2 | 8/2011 |
| EP | 3059496 | B1 | 10/2018 |
| EP | 2357410 | B1 | 7/2019 |
| JP | S62166221 | A | 7/1987 |
| WO | 2015104021 | A1 | 7/2015 |

* cited by examiner

FLAME MONITORING DEVICE FOR A GAS BURNER APPLIANCE AND GAS BURNER APPLIANCE

CROSS-REFERENCE TO RELATED APPLICATIONS

This application is a U.S. National Phase patent application under 35 U.S.C. 371 of International Application No. PCT/EP2021/052415 filed Feb. 2, 2021, which claims the benefit of and priority to European Patent Application No. 20158241.8, filed on Feb. 19, 2020, each of which are incorporated herein by reference in their entireties.

The present invention relates to a flame monitoring device for a gas burner appliance and to a gas burner appliance.

Gas burner appliances known from prior art comprise a flame ionization sensor for monitoring a flame which results from the combustion of a combustible gas. EP 2 354 657 A2, EP 2 357 410 B1, EP 3 059 496 B1 disclose such gas burner appliances comprising a flame ionization sensor. DE 10 2008 005 216 B3 discloses a method for controlling the operation of a gas burner appliances on basis of an electrical flame ionization current provided by flame ionization sensor. Such gas burner appliances have a controller using the electrical flame ionization current as input signal.

The gas burner appliances known from prior art which comprise a flame ionization sensor require that the combustion of the combustible gas results into a flame with ions. Otherwise the flame ionization sensor cannot monitor the flame. The combustion of methane as combustible gas results into a flame with ions. However, the combustion of e.g. hydrogen as combustible gas results into a flame without ions. So, gas burner appliances installed in the field having flame ionization sensor cannot be used for the combustion of hydrogen.

CN 203 162 944 U discloses a hydrogen burner appliance.

DE 42 28 948 A1 discloses flame monitoring device for a burner monitoring shock waves.

Against this background a novel flame monitoring device for a gas burner appliance is provided which can be also used for the flame monitoring of flames without ions and providing an output signal corresponding to an electrical flame ionization current.

Further, a gas burner appliance having such a flame monitoring device is pro-vided.

The flame monitoring device according to the present invention is defined in the claim 1. The flame monitoring device according to the present invention comprises a flame supervision device providing as measurement signal an electrical voltage signal depending on the presence of the flame. The flame monitoring device further comprises an electronic circuit converting the electrical voltage signal provided by the flame supervision device into an electrical current signal. The electrical current signal provided by the electronic circuit corresponds to an electrical flame ionization current. The novel flame monitoring device can be used for the flame monitoring of flames without ions.

The flame monitoring device according to the present invention may provide a conversion kit for a gas burner appliance having a flame ionization sensor and a controller adapted to use as input signal an electrical flame ionization current provided by the flame ionization sensor, namely by replacing the flame ionization sensor by the flame monitoring device and by keeping the controller.

Preferably, the flame supervision device is a thermocouple. A thermocouple is simple, reliable and cost-effective. A thermocouple provides an electrical voltage signal depending on the presence of the flame Preferably, the electronic circuit comprises a comparator comparing the electrical voltage signal provided by the flame supervision device with a nominal value to determine if a flame is present or not present, and a converter converting the electrical voltage signal provided by the flame supervision device into the electrical current signal. Such an electronic circuit is simple, reliable and cost-effective. The electronic circuit coverts the electrical voltage signal into the electrical current signal which corresponds to an electrical flame ionization current.

The gas burner appliance of the present invention is defined in claim 7.

Preferred developments of the invention are provided by the dependent claims and the description which follows. Exemplary embodiments are explained in more detail on the basis of the drawing, in which:

Figure 1:
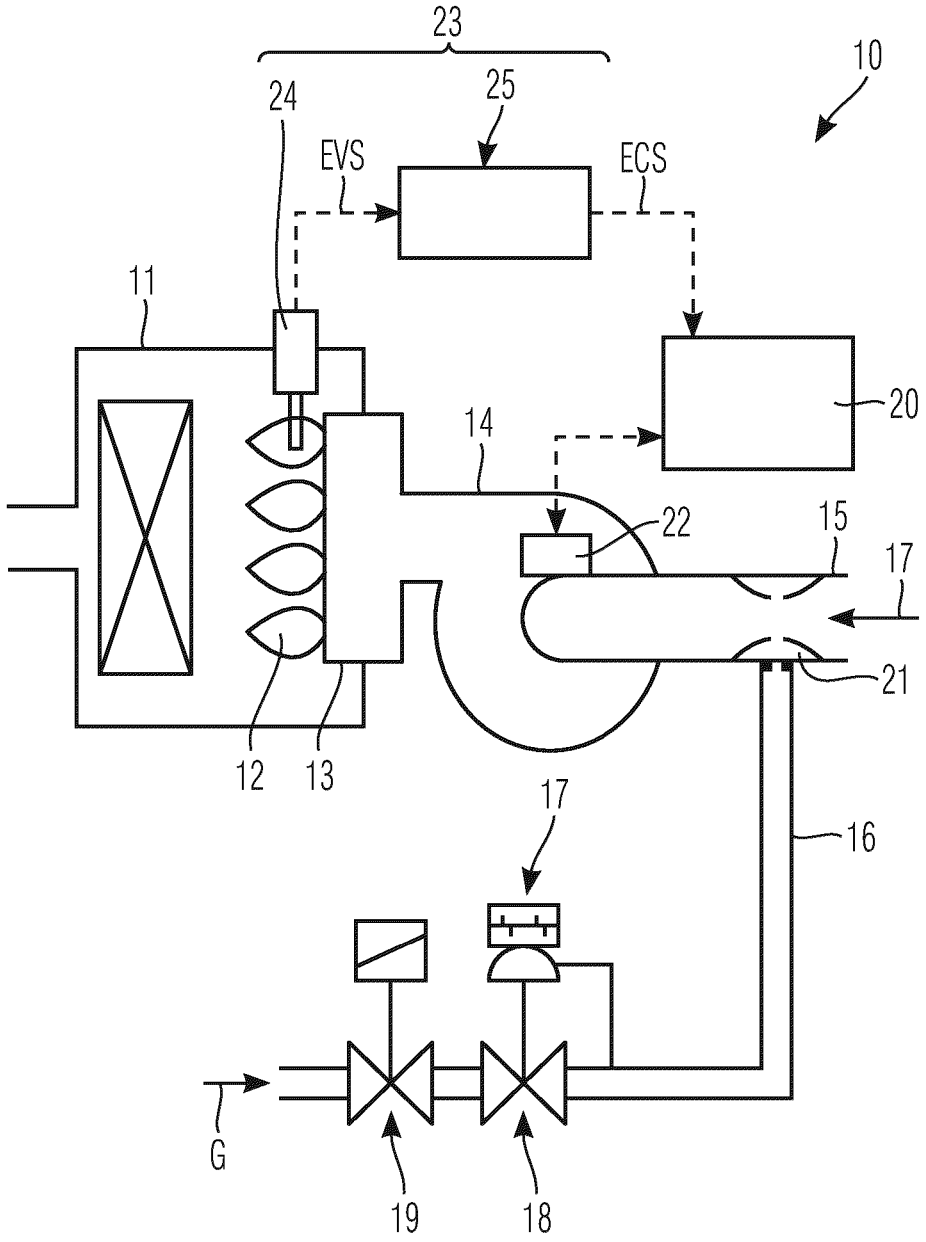
FIG. 1 shows a schematic view of a gas burner appliance having a flame monitoring device according to the present invention.
Figure 2:
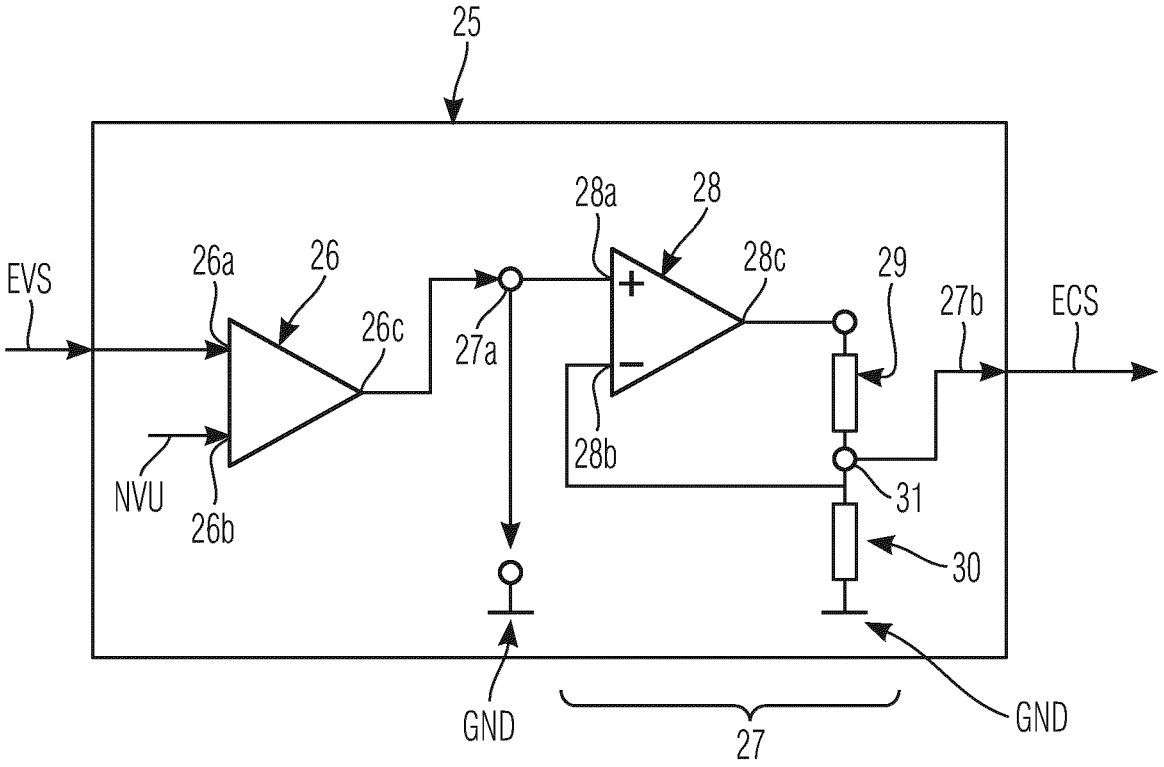
FIG. 2 shows a block diagram of an electronic circuit of the flame monitoring device according to the present invention.

FIG. 1 shows a schematic view of a gas burner appliance 10. The gas burner appliance 10 comprises a gas burner chamber 11 with a gas burner surface 13 in which combustion of a gas/air mixture having a mixing ratio of combustible gas G and air A takes place during burner-on phases of the gas burner appliance 10. The combustion of the gas/air mixture results into flames 12.

The gas/air mixture is provided to the burner chamber 11 of the gas burner appliance 10 by mixing an air flow with a gas flow. A fan 14 sucks in air A flowing through an air duct 15 and gas G flowing through a gas duct 16. A gas regulating valve 18 for adjusting the gas flow through the gas duct 16 and a gas safety valve 19 are assigned to the gas duct 16.

The gas/air mixture having the mixing ratio of gas and air is provided to the burner chamber 11 of the gas burner appliance 10. The gas/air mixture is pro-vided by mixing the air flow provided by an air duct 15 with a gas flow provided by a gas duct 16. The air flow and the gas flow become preferably mixed by a mixing device 21. Such a mixing device 21 can be designed as a so-called Venturf nozzle.

The quantity of the air flow and thereby the quantity of the gas/air mixture flow is adjusted by the fan 14, namely by the speed of the fan 14. The fan speed can be adjusted by an actuator 22 of the fan 14.

The fan speed of the fan 14 is controlled by a controller 20 generating a control variable for the actuator 22 of the fan 14.

The defined mixing ratio of the defined gas/air mixture is controlled by the gas regulating valve 18, namely by a pneumatic controller 17 of the same. The pneumatic controller 17 of the gas regulating valve 18 controls the opening/closing position of the gas valve 18.

The position of the gas valve 18 is adjusted by the pneumatic controller 17 on basis of a pressure difference between the gas pressure of the gas flow in the gas pipe 16 and a reference pressure. The gas regulating valve 18 is controlled by the pneumatic controller 17 in such a way that at the outlet of the gas valve 18 the pressure is equal to the reference pressure.

In FIG. 1, the ambient pressure serves as reference pressure. However, it is also possible to use the air pressure of the air flow in the air duct 15 as reference pressure. The pressure difference between the gas pressure and the reference pressure is determined pneumatically by pneumatic sensor of the pneumatic controller 17.

Alternatively, it is possible to determine the pressure difference between the gas pressure of the gas flow in the gas pipe and the reference pressure electronically by an electric sensor (not shown). In this case, the gas valve 18 would be controlled by an electronic controller, e.g. by the controller 20.

In any case, the mixing ratio of the defined gas/air mixture is controlled is such a way that over the entire modulation range of the gas burner appliance 10 the defined mixing ratio of the defined gas/air mixture is kept constant.

A modulation of "1" means that the fan 14 is operated at maximum fan speed and thereby at full-load of the gas burner. A modulation of "5" means that the fan 14 is operated at 20% of the maximum fan speed and a modulation of "10" means that the fan 14 is operated at 10% of the maximum fan speed.

By changing the fan speed of the fan 14 the load of the gas burner appliance 10 can be adjusted. Over the entire modulation range of the gas burner appliance 10 the defined mixing ratio of the defined gas/air mixture is kept constant.

As described above, the mixing ratio of the defined gas/air mixture is controlled during burner-on phases so that over the entire modulation range of the gas burner appliance 10 the defined mixing ratio of the gas/air mixture is kept constant.

The controller 20 controls the operation of the gas burner appliance 10 on basis of a signal provides by a flame monitoring device 23.

The flame monitoring device 23 comprises a flame supervision device 24 providing as measurement signal an electrical voltage signal EVS depending on the presence of the flame 12. The flame supervision device 24 is preferably provided by a thermocouple.

The flame monitoring device 23 further comprises an electronic circuit 25 converting the electrical voltage signal EVS provided by the flame supervision device 24 into an electrical current signal ECS.

The flame supervision device 24 of the flame monitoring device 23 provides the electrical voltage signal EVS independent from the presence of ions in the flame 20. The electronic circuit 25 of the flame monitoring device 23 converts the electrical voltage signal EVS into the electrical current signal ECS that corresponds to electrical flame ionization current.

The flame monitoring device 23 according to the present invention may provide a conversion kit for a gas burner appliance 10 having a flame ionization sensor and a controller 20 adapted to use as input signal an electrical flame ionization current provided by the flame ionization sensor, namely by replacing the flame ionization sensor by the flame monitoring device 23 and by keeping the controller 20. So, a gas burner appliance being configured to combust methane as combustible gas can easily be adapted to a gas burner appliance being configured to combust hydrogen as combustible gas without the need to replace the controller 20.

The electronic circuit 25 of the flame monitoring device 23 comprises a comparator 26. The comparator 26 compares the electrical voltage signal EVS provided by the flame supervision device 24 with a nominal value NVU to determine if a flame 12 is present or not present. Said comparator 26 has a first input terminal 26*a* connected to the flame supervision device 24, a second input terminal 26*b* at which the nominal value NVU is present and an output terminal 26*c*.

When the electrical voltage signal EVS is greater than the nominal value NVU, the presence of a flame 12 is detected and the electrical voltage signal EVS is provided at the output terminal 26*c*.

When the electrical voltage signal EVS is smaller than the nominal value NVU, the non-presence of a flame 12 is detected and the electrical voltage signal EVS is not provided at the output terminal 26*c*.

The electronic circuit 25 of the flame monitoring device 23 comprises further a converter 27 converting the electrical voltage signal EVS into the electrical current signal ECS.

The converter 27 has a input terminal 27*a* connected to the output terminal 26*c* of the comparator 26 and an output terminal 27*b*.

The converter 27 of the electronic circuit 25 of the flame monitoring device 23 comprises a second comparator 28 with a first input terminal 28*a* providing the input terminal 27*a* of the converter 27, a second input terminal 28*b* and an output terminal 28*c*.

The converter 27 of the electronic circuit 25 of the flame monitoring device 23 comprises further a first electrical resistor 29 and a second electrical resistor 30 connected in series between the output terminal 28*c* of the second comparator 28 and ground GND.

The second input terminal 28*b* of the second comparator 28 and the output terminal 27*b* of the converter 27 are both connected to a terminal 31 provided between the first electrical resistor 29 and the second electrical resistor 30.

The invention further provides a gas burner appliance 10. The gas burner appliance 10 comprises a burner chamber 11 for burning a combustible gas, the combustion of the combustible gas resulting into a flamel 2. The gas burner appliance 10 comprises a flame monitoring device 23 as described above and a controller 20 for controlling the operation of the gas burner appliance 10 on basis of a signal provided by the flame monitoring device 23.

The gas burner appliance 10 is configured to burn a combustible gas, wherein the combustion of this gas G results into a flame 12 without ions. The combustible gas G may contain hydrogen in an amount up to up to 100%. The combustible gas G may be hydrogen.

LIST OF REFERENCE SIGNS

10 gas burner appliance
11 gas burner chamber
12 flame
13 gas burner surface
15 air duct
16 gas duct
17 pneumatic controller
18 gas valve/regulating valve
19 gas valve/safety valve
20 controller
21 mixing device
22 actuator
23 flame monitoring device
24 flame supervision device
25 electronic circuit
26 comparator
26*a* input terminal
26*c* input terminal
26*c* output terminal
27 converter
27*a* input terminal
27*b* output terminal
28 comparator

28*a* input terminal
28*b* input terminal
28*c* output terminal
29 electrical resistor
30 electrical resistor
31 terminal

The invention claimed is:

1. A flame monitoring device comprising:

a flame supervision device positioned in a gas burner appliance;

wherein the gas burner appliance is configured to combust a combustible gas in a gas burner chamber;

wherein combusting the combustible gas produces non-ionized flame;

wherein the flame supervision device is configured to produce a measurement signal comprising an electrical voltage signal representative of a presence of the non-ionized flame; and an electronic circuit configured to convert the electrical voltage signal provided into an electrical current signal;

wherein the electronic circuit is configured to output the electrical current signal to be compatible with a controller configured to control the gas burner appliance based on the electrical current signal being indicative of flame ionization, wherein the electronic circuit comprises:

a comparator comparing the electrical voltage signal provided by the flame supervision device with a nominal value to determine if a flame is present or not present; and a converter converting the electrical voltage signal provided by the flame supervision device into the electrical current signal;

wherein the comparator has a first input terminal connected to the flame supervision device, a second input terminal at which the nominal value is present and an output terminal;

wherein the converter has an input terminal connected to the output terminal of the comparator and an output terminal;

wherein the converter comprises:

a second comparator with a first input terminal providing the input terminal of the converter, a second input terminal and an output terminal; and a first electrical resistor and a second electrical resistor connected in series to the output terminal of the second comparator;

wherein the second input terminal of the second comparator and the output terminal of the converter are both connected to a terminal provided between the first electrical resistor and the second electrical resistor.

2. The flame monitoring device of claim 1, wherein the electrical current signal provided by the electronic circuit corresponds to an electrical flame ionization current.

3. The flame monitoring device of claim 1, wherein the flame supervision device is a thermocouple.

4. A flame monitoring system comprising:

a conversion kit for a gas burner appliance;

wherein the gas burner appliance comprises a flame ionization sensor and a controller;

wherein the flame ionization sensor is configured to produce a flame ionization current based on a presence of ions of a flame;

wherein the controller is configured detect the flame in a gas burner chamber based at least in part on the flame ionization current;

wherein the conversion kit comprises:

a flame supervision device positioned in a gas burner appliance;

wherein the gas burner appliance is configured to combust a combustible gas in a gas burner chamber;

wherein combusting the combustible gas produces non-ionized flame;

wherein the flame supervision device is configured to produce a measurement signal comprising an electrical voltage signal representative of a presence of the non-ionized flame; and an electronic circuit configured to convert the electrical voltage signal provided into an electrical current signal;

wherein the electronic circuit is configured to output the electrical current signal to be compatible with a controller configured to control the gas burner appliance based on the electrical current signal being indicative of flame ionization, wherein the electronic circuit comprises:

a comparator comparing the electrical voltage signal provided by the flame supervision device with a nominal value to determine if a flame is present or not present; and a converter converting the electrical voltage signal provided by the flame supervision device into the electrical current signal;

wherein the comparator has a first input terminal connected to the flame supervision device, a second input terminal at which the nominal value is present and an output terminal;

wherein the converter has an input terminal connected to the output terminal of the comparator and an output terminal;

wherein the converter comprises:

a second comparator with a first input terminal providing the input terminal of the converter, a second input terminal and an output terminal; and a first electrical resistor and a second electrical resistor connected in series to the output terminal of the second comparator;

wherein the second input terminal of the second comparator and the output terminal of the converter are both connected to a terminal provided between the first electrical resistor and the second electrical resistor.

5. A gas burner appliance, comprising:

a gas burner chamber configured for burning a combustible gas, the combustion of the combustible gas resulting into a flame;

a flame supervision device positioned in a gas burner appliance;

wherein the gas burner appliance is configured to combust a combustible gas in the gas burner chamber;

wherein combusting the combustible gas produces non-ionized flame;

wherein the flame supervision device is configured to produce a measurement signal comprising an electrical voltage signal representative of a presence of the non-ionized flame;

an electronic circuit configured to convert the electrical voltage signal provided into an electrical current signal;

wherein the electronic circuit is configured to output the electrical current signal to be compatible with a controller configured to control the gas burner appliance based on the electrical current signal being indicative of flame ionization; and the controller configured to control operation of the gas burner appliance based on the electrical current signal being indicative of flame ionization, wherein the electronic circuit comprises:

a comparator comparing the electrical voltage signal provided by the flame supervision device with a nominal value to determine if a flame is present or not present; and a converter converting the electrical voltage signal provided by the flame supervision device into the electrical current signal;

wherein the comparator has a first input terminal connected to the flame supervision device, a second input terminal at which the nominal value is present and an output terminal;

wherein the converter has an input terminal connected to the output terminal of the comparator and an output terminal;

wherein the converter comprises:

a second comparator with a first input terminal providing the input terminal of the converter, a second input terminal and an output terminal; and a first electrical resistor and a second electrical resistor connected in series to the output terminal of the second comparator;

wherein the second input terminal of the second comparator and the output terminal of the converter are both connected to a terminal provided between the first electrical resistor and the second electrical resistor.

6. The gas burner appliance of claim 5, wherein the gas burner chamber is configured to burn the combustible gas comprising hydrogen in an amount up to up to 100%.

7. The gas burner appliance of claim 5, wherein the gas burner chamber is configured to burn hydrogen as the combustible gas.

8. The gas burner appliance of claim 5, wherein the electrical current signal provided by the electronic circuit corresponds to an electrical flame ionization current.

9. The gas burner appliance of claim 5, wherein the flame supervision device is a thermocouple.

10. The flame monitoring system of claim 4, wherein the electrical current signal provided by the electronic circuit corresponds to an electrical flame ionization current.

11. The flame monitoring system of claim 4, wherein the flame supervision device is a thermocouple.

* * * * *